US005257594A

United States Patent [19]

Methven

[11] Patent Number: 5,257,594

[45] Date of Patent: Nov. 2, 1993

[54] SUITCASE BOAT

[76] Inventor: Robert W. Methven, 984 S. Victor Way, Aurora, Colo. 80012

[21] Appl. No.: 48,150

[22] Filed: Apr. 15, 1993

Related U.S. Application Data

[63] Continuation-in-part of Ser. No. 853,908, Mar. 19, 1992, Pat. No. 5,203,276.

[51] Int. Cl.[5] ..... B63H 9/04

[52] U.S. Cl. ..... 114/354; 114/39.1; 114/61; 114/162

[58] Field of Search ..... 114/39.1, 61, 123, 162, 114/343, 352, 353, 354

[56] References Cited

U.S. PATENT DOCUMENTS

| | | | |
|---|---|---|---|
| 1,932,245 | 10/1933 | Horak | 114/354 |
| 2,916,748 | 12/1959 | Stahmer | 114/352 |
| 2,919,451 | 1/1960 | Long | 114/352 |
| 3,126,558 | 3/1964 | Nolan et al. | 114/352 |
| 3,179,960 | 4/1965 | Nimmo | 114/354 |
| 4,319,538 | 3/1982 | Macfarlane | 114/162 |
| 4,553,496 | 11/1985 | Foresman | 114/162 |
| 4,998,498 | 3/1991 | Gallichan | 114/354 |
| 5,203,276 | 4/1993 | Methven | 114/354 |

*Primary Examiner*—David M. Mitchell
*Assistant Examiner*—Stephen P. Avila
*Attorney, Agent, or Firm*—Mason, Kolehmainen, Rathburn & Wyss

[57] ABSTRACT

A suitcase boat in accordance with the invention comprises a platform or hull for supporting a person and/or objects while the boat is floating on the water and the hull comprises a plurality of pan sections interconnected along a transverse axis normal to a longitudinal axis of the boat when the pan sections are in an extended position end to end. The pan sections are relatively foldable or pivotable about the transverse axis to a confronting position forming a hollow rectangular enclosure similar to a suitcase for carrying a plurality of detached flotation elements, seats and other components of the boat. The flotation elements are detachably securable to the pan sections in an extended position for supporting the boat on the water. The flotation elements are dimensioned for containment within the hollow enclosure when the pan sections are in the confronting position for easy carrying. The flotation elements are securable to the extended pan sections at a plurality of different levels to provide a flat bottom or tunnel hull boat. The boat is useful as a rowboat, dinghy, power boat, sail boat or motor boat and can be easily carried and transported from place to place when folded up in suitcase form.

14 Claims, 3 Drawing Sheets

SUITCASE BOAT

RELATED APPLICATION

This application is a continuation-in-part of copending United States patent application Ser. No. 07/853,908, filed Mar. 19, 1992, and issued as U.S. Pat. No. 5,203,276 on Apr. 20, 1993.

BACKGROUND OF THE INVENTION

1. Field of the Invention

The present invention relates to a new and improved suitcase boat which includes at least one pair of interconnected pan sections which may be positioned to provide an elongated boat for the water when flotation elements are secured thereto. When the pan sections are folded up to confront one another they form a hollow enclosure or suitcase for containing the flotation elements therein and flexible straps may be provided for securing the pan sections together in suitcase form for easy carrying and traveling on commercial aircraft and the like where space is at a premium.

2. Background of the Prior Art

Fold-up boats, inflatable boats and a wide variety of wood, foam and fiberglass dinghies are available for use as yacht tenders, rowboats, power boats and sailing boats.

OBJECTS OF THE INVENTION

It is an object of the invention to provide a new and improved suitcase boat which is easily transportable in the form of a suitcase-like package.

Another object of the present invention is to provide a new and improved suitcase boat of the type described which easily changes from a folded up suitcase form to an unfolded or extended boating position when used as a boat on the water.

Another object of the present invention is to provide a new and improved suitcase boat of the character described wherein the boat hull comprises a plurality of unitary pan sections arranged in end to end relation and flotation elements detachably securable to opposite sides of said pan sections to provide flotation for the boat.

Another object of the present invention is to provide a new and improved suitcase boat of the character described wherein said pan sections are movable to a confronting position wherein each pan section forms a half of a suitcase-like enclosure for containing said flotation elements while detached.

Yet another object of the present invention is to provide a new and improved suitcase boat of the character described wherein said flotation elements may be detachably mounted at two different levels on opposite sides of said end to end pan sections to provide a flat bottom boat or a tunnel hull boat as desired.

Still another object of the present invention is to provide a new and improved suitcase boat of the character described including detachable seat(s) and a transom which can be carried in said confronting pan sections along with said flotation elements.

Another object of the present invention is to provide a new and improved suitcase boat of the character described wherein a detachable seat is provided amidships above an interconnection between end to end pan sections of said boat.

Still another object of the present invention is to provide a new and improved suitcase boat of the character described which readily unfolds from suitcase form to provide a boat that supported on the water with a plurality of flotation elements detachably secured thereto.

Another object of the present invention is to provide a new and improved suitcase boat of the character described which can function as a dinghy or a yacht tender, a rowboat, a power boat, a sail boat or a fishing boat as the case may be.

Still another object of the present invention is to provide a new and improved suitcase boat of the character described which employs a plurality of substantially identical flotation elements adapted to be detachably interconnected to a substantially planar platform for supporting a person or persons and gear.

Yet another object of the present invention is to provide a new and improved suitcase boat which occupies a minimum amount of space or volume when folded up and thus is easily transportable in suitcase form on airplanes and other public conveyances.

Still another object of the present invention is to provide a new and improved suitcase boat which is relatively low in cost, relatively light in weight, relatively small in volume when in suitcase form and yet capable of providing normal functions of a floating platform, a dinghy, a small sail boat or power boat, a rowboat or a fishing boat.

BRIEF SUMMARY OF THE PRESENT INVENTION

The foregoing and other objects and advantages of the present invention are accomplished in a new and improved suitcase boat comprising a platform or hull formed by a plurality of interconnected pan sections in an end to end relation with flotation elements attached on the sides for supporting a person and/or gear while the boat is floating on the water. Each pan section includes a bottom wall, a first pair of opposite side walls joined on opposite edges of said bottom wall and a second pair of transverse end walls joining the ends of said side walls and transverse opposite edges of said bottom wall. Preferably, the pan sections are hingedly interconnected along a transverse axis that is perpendicular to a longitudinal axis of the boat. The pan sections are relatively movable between a confronting position forming a hollow, rectangular enclosure similar to the form of a suitcase and an extended, end to end position for use as a boat. A plurality of flotation elements are adapted to be detachably secured to opposite side walls of the pan sections when in extended end to end position for supporting the boat on the water. These flotation elements are attachable at a plurality of levels to provide a flat bottom or a tunnel hull boat. Pairs of flotation elements are substantially identical to one another and are dimensioned to be contained within the hollow suitcase enclosure when the pan sections are in the confronting position for easy carrying. Flexible straps are provided for securing the pan sections together in the confronting position containing the flotation elements. Detachable seats and a transom are provided and when detached, these items can be carried within the suitcase enclosure along with the flotation elements.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
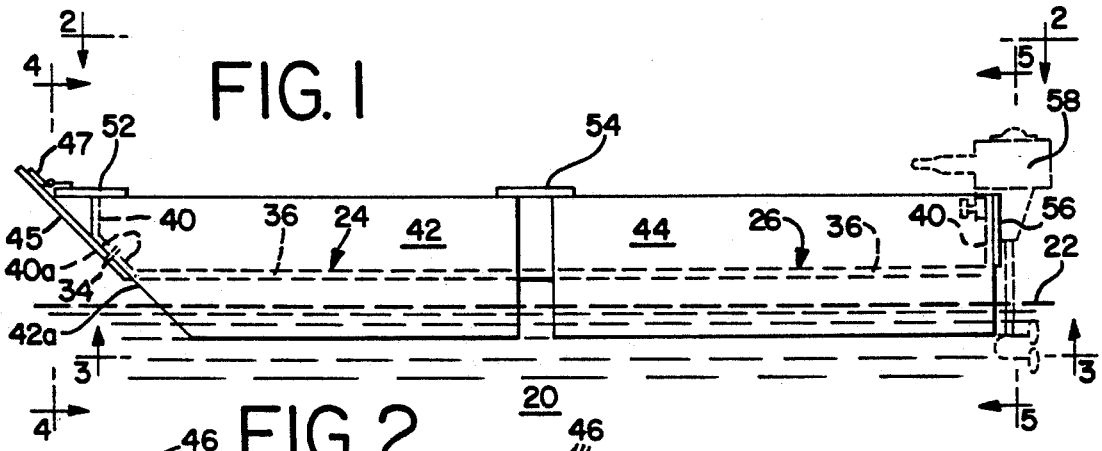
FIG. 1 is a side elevational view of a new and improved suitcase boat constructed in accordance with the features of the present invention and shown with a pair of pan sections in an end to end extended position while the boat is floating on a water surface.

Referring now more particularly to the drawings, therein is illustrated a new and improved suitcase boat constructed in accordance with the features of the present invention and referred to generally by the reference numeral 20. As illustrated in FIGS. 1-7, the boat 20 in an extended or opened up condition is useful as a floating platform or raft, a rowboat, a small sailboat, dinghy, etc., while floating on the water 22.

Figure 3:
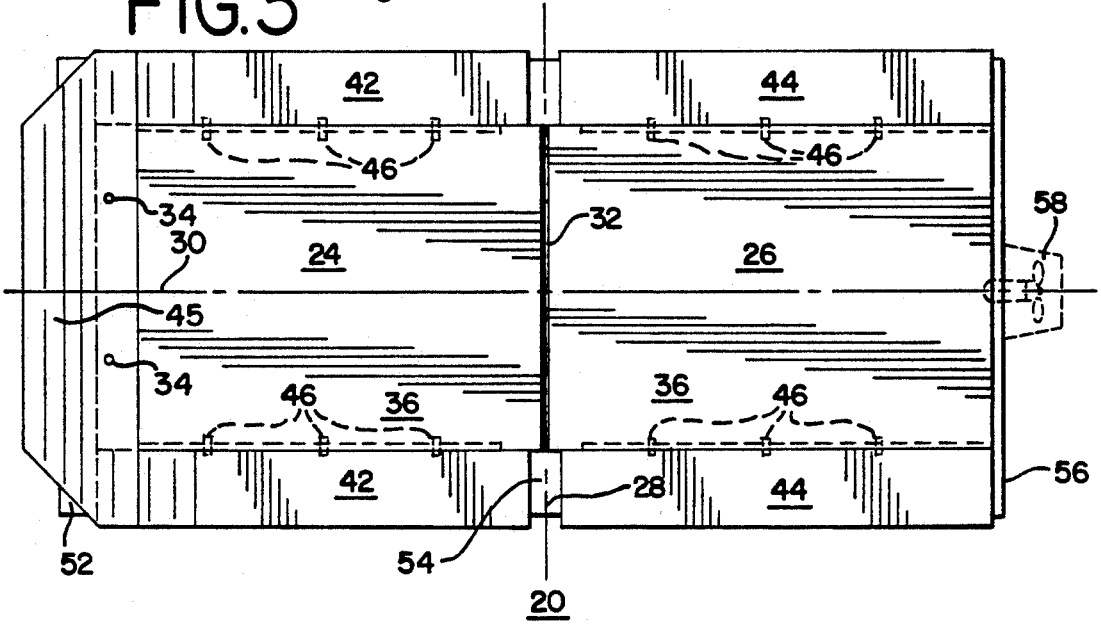
FIG. 3 is a bottom plan view of the boat looking upwardly in the direction of arrows 3—3 of FIG. 1.

A central hull segment or platform portion of the boat 20 is made up of a plurality of pan sections 24 and 26 interconnected together (FIGS. 9 and 9A) along a transverse axis 28 located amidships and generally normal or perpendicular to a longitudinal axis 30 of the boat as best shown in FIG. 3. When the pan sections 24 and 26 are interconnected together in an extended position as shown, an elongated hull or platform is formed for carrying persons and things while the boat is floating on the water.

Figure 9A:
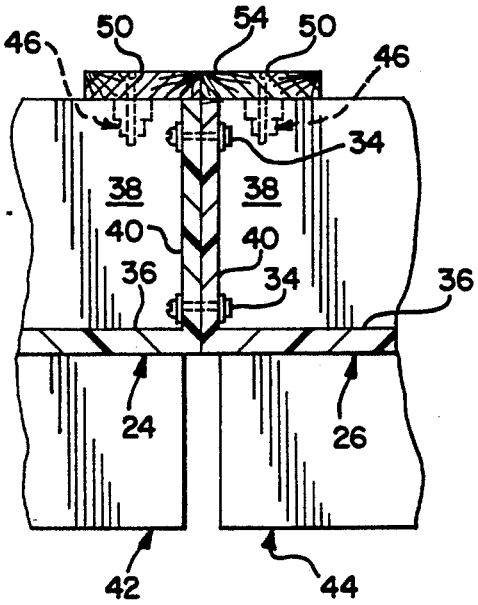
FIG. 9A is an enlarged fragmentary cross-sectional view similar to FIG. 9 illustrating an alternate type of interconnection between end to end pan sections of the boat.
Figure 10:
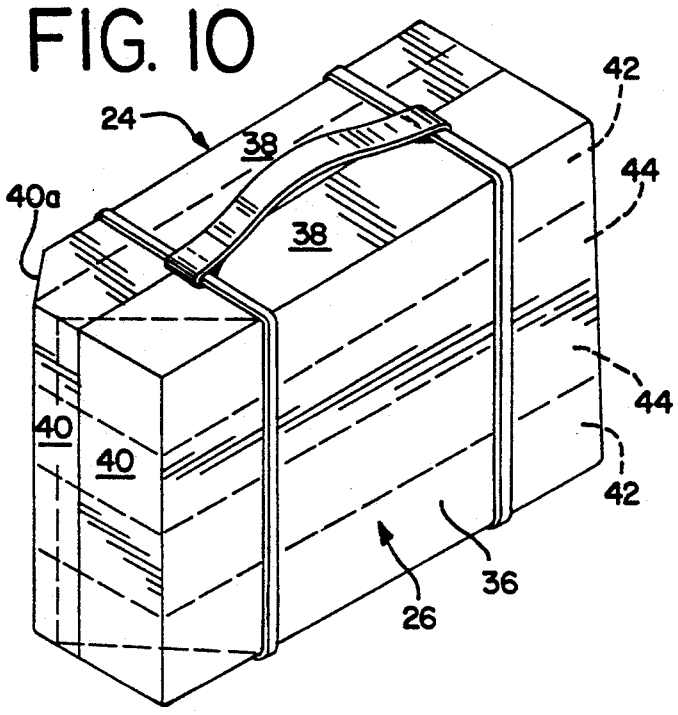
FIG. 10 is a perspective view of the boat in suitcase form ready for carrying.
Figure 9:
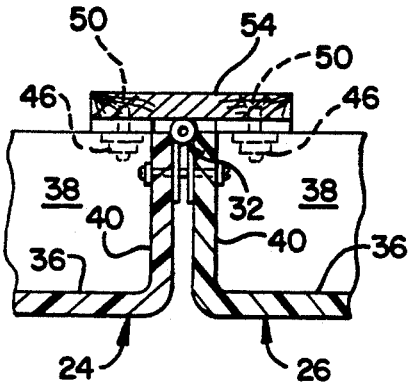
FIG. 9 is an enlarged fragmentary cross-sectional view taken substantially along line 9—9 of FIG. 2.
Figure 11:
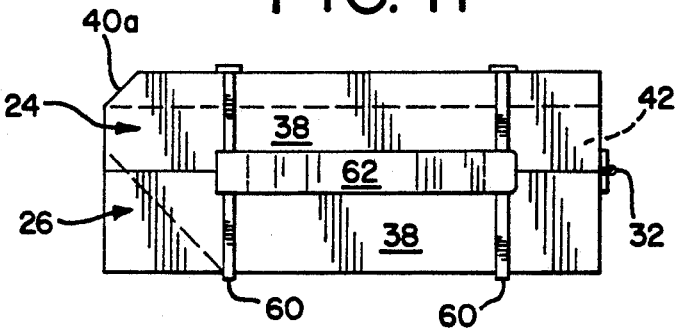
FIG. 11 is a top view of the boat in suitcase form.

The pan sections 24 and 26 may be permanently hingedly interconnected together as shown in FIG. 9 with a piano type hinge 32 extending along the transverse axis 28 or may be detachably interconnected on a semipermanent basis by means of a plurality of fasteners 34 as shown in FIG. 9A.

The pan sections 24 and 26 are relatively movable to pivot about the transverse axis 28 from the extended end to end position for boating on the water. FIGS. 1-7 to a confront position as shown in FIGS. 10-13 forming a suitcase-like enclosure ready for easy carrying or transport from place to place.

Preferably, the pan sections 24 and 26 are formed of integrally molded, one piece resinous plastic material of suitable strength, stiffness and thickness to serve as boat hull portions. Each pan section 24 and 26 includes a generally rectangular-shaped bottom wall 36 forming a bottom of the boat hull (FIGS. 1-7) and also forming opposite side walls of the suitcase enclosure (FIGS. 10-13) when the pan sections 24 and 26 are in confronting position.

Each pan section 24 and 26 includes a pair of opposite side walls 38 integrally joining the bottom wall 36 forming opposite sides of the boat hull when the pan sections are in the extended, end to end position (FIGS. 1-7). The walls 38 also serve as upper and lower wall portions of the suitcase enclosure (FIGS. 10-12) when the pan sections are in the confronting position.

Each pan section 24 and 26 further includes a pair of transverse end walls 40 integrally joining transverse edges of the bottom wall 36 and joined at opposite ends the ends of the walls 38. As shown in FIG. 9, amidships end walls 40 from each of the respective pan sections 24 and 26 are hingedly interconnected by the piano hinge 32 and as shown in FIG. 9A, the amidships end walls 40 may also be secured together by the fasteners 34. At the forward end of the boat hull, the end wall 40 of the forward pan section 24 has a sloping lower segment 40*a* to deflect water downwardly when the boat is under way. A sloping water deflecting shield 45 extending upwardly of the upper edge of the forward end wall 40 may be attached to the lower wall segment 40*a* with fasteners 34, and the shield is also secured by hinges 47 to a forward seat 52. The end walls 40 also form end walls of the suitcase enclosure (FIGS. 10-11) when the pan sections 24 and 26 are in the confronting position.

In accordance with the present invention, the suitcase boat 20 includes a plurality of pairs of elongated flotation elements 42 and 44 preferably formed of lightweight, strong, closed cell polyurethane or polystyrene foam. The flotation elements or floats 42 and 44 of each pair are substantially identical and have a generally rectangular transverse cross-section as shown in FIGS. 4-7. Preferably, the foam body of the floats 42 and 44 are encased within a polyethylene or polypropylene jacket 43 and each forward float 42 is provided with a beveled portion 42*a* at the forward end (FIG. 1) so that when a pair of fore and aft floats 42 and 44 are aligned end to end along opposite sides of the extended pan sections 24 and 26, the beveled end portions 42*a* of each forward float 42 faces in a forward direction.

When the suitcase boat 20 is folded up for transport with the pan sections 24 and 26 in confronting position as shown in FIGS. 10-13, the floats 42 and 44 are all contained within the interior of the hollow enclosure and accordingly, the floats are properly dimensioned to fit neatly within the interior space provided as shown in dotted lines.

Figure 2:
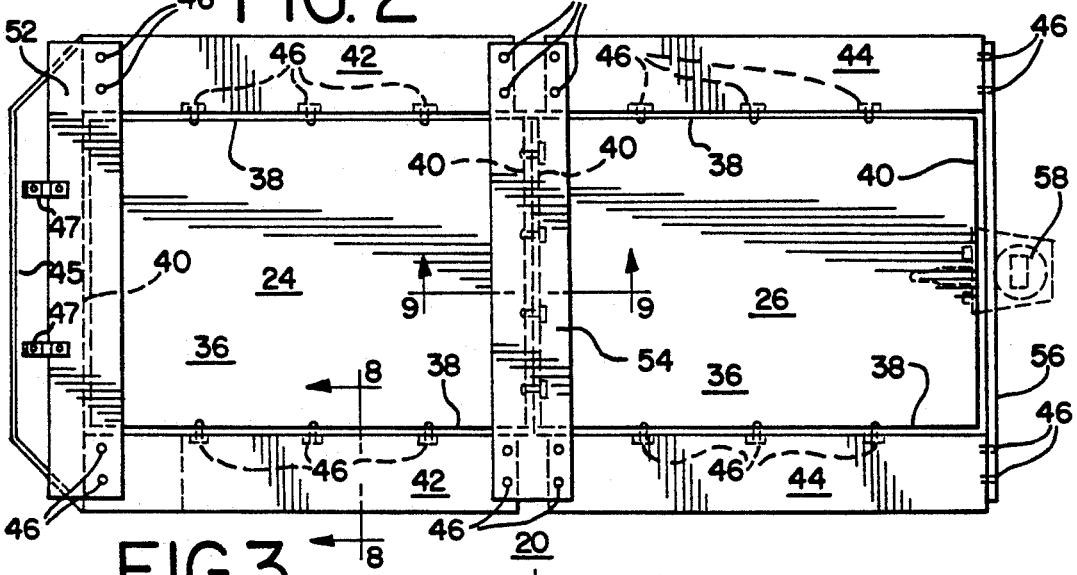
FIG. 2 is a top plan view of the boat looking downwardly along lines 2—2 of FIG. 1.

In accordance with the present invention, each float 42 and 44 is detachably secured to a side wall 38 of a pan section 24 or 26 in extended or unfolded position as shown in FIGS. 1-7 by pairs of upper and lower fastener assemblies 46 (FIG. 8) provided at spaced apart locations longitudinally of the boat as shown in FIGS. 2, 3 and 9. Each fastener assembly 46 may include a nut plate 48 fixed to a float 42 or 44 inside of the jacket 43 adapted to threadedly receive a cap screw 50 extending through the adjacent side wall 38 of a pan section 24 or 26.

Figure 4:
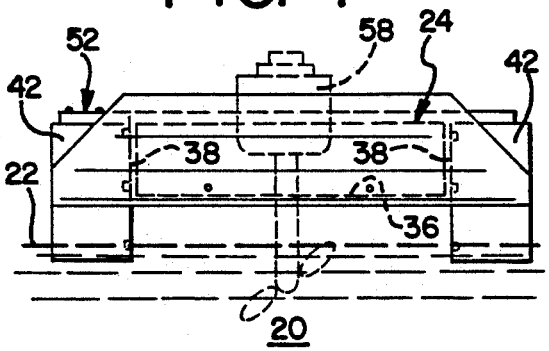
FIG. 4 is a front end elevational view of the boat looking in the direction of arrows 4—4 of FIG. 1 with the floats attached at a low level to provide a tunnel hull boat.
Figure 5:
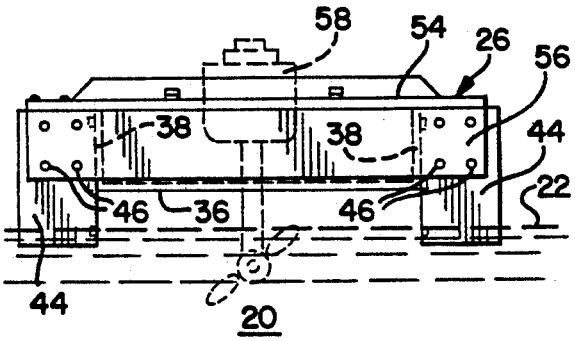
FIG. 5 is a rear end elevational view of the boat looking in the direction of arrows 5—5 of FIG. 1.
Figure 6:
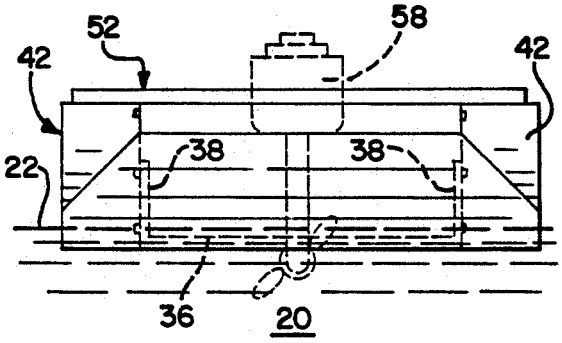
FIG. 6 is a front end elevational view of the boat similar to FIG. 4, but with the floats attached at a different level to provide a flat bottom hull.
Figure 7:
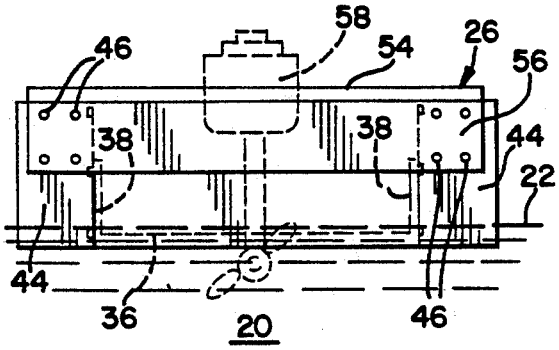
FIG. 7 is a rear end elevational view of the boat similar to FIG. 5 but with the floats attached at a different level to provide a flat bottom boat.
Figure 8:
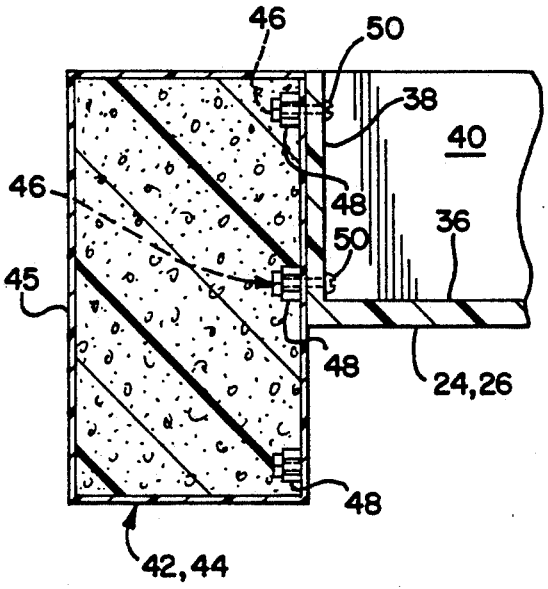
FIG. 8 is an enlarged fragmentary cross-sectional view taken substantially along line 8—8 of FIG. 2.

In reference to FIG. 8, three vertically spaced apart rows of fastener nut plates 48 are provided on the inside of each float 42 and 44, each row at a different level. When cap screws 50 are extended through marked openings in the jacket 43 of the floats at the upper two levels of nut plates 48, the floats provide a tunnel type boat hull as shown in FIGS. 4 and 5 wherein the bottom wall 36 of the pan sections 24 and 26 are spaced above the bottom surface of the floats 42 and 44. If the bottom two levels of nut plates 48 are used, the bottom wall 36 of the pan sections 24 and 26 is at substantially the same level as the bottom surface of the floats 42 and 44 to provide a flat bottom boat hull for the suitcase boat 20.

In accordance with the invention, the suitcase boat 20 includes a detachably mounted seat 52 at the forward end, a detachably mounted seat 54 amidships above the interconnection axis 28 between pan sections 24 and 26, a detachable transom 56 at the rear end for supporting an outboard or electric trolling motor 58.

Figure 12:
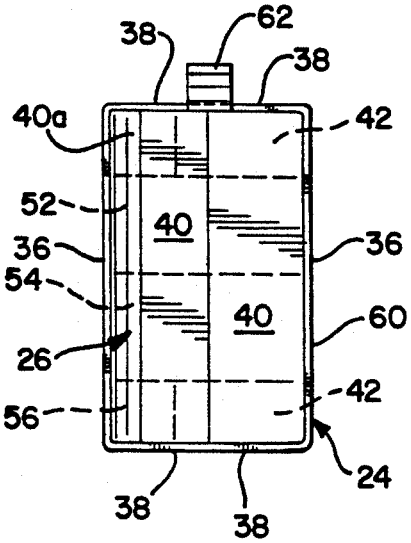
FIG. 12 is an end elevational view of the boat in suitcase form.
Figure 13:
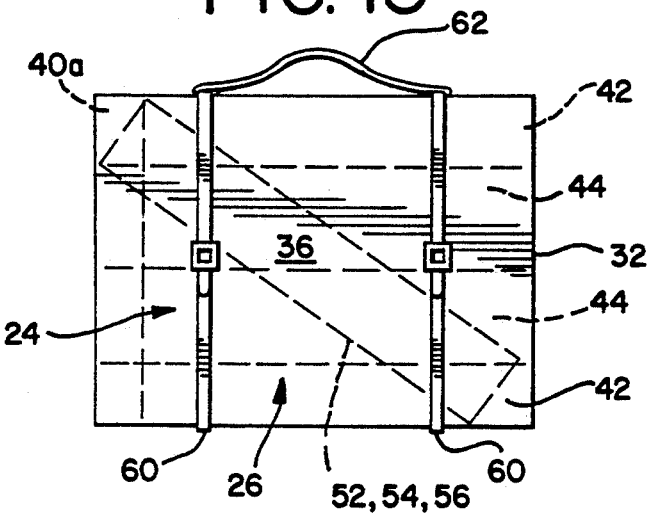
FIG. 13 is a side elevational view of the boat in suitcase form.

The seats 52 and 54 and the transom 56 can be made of wood or plywood and the end portions of the seats are secured to the upper surface of the floats 42 and 44 with fastener assemblies 46 whereas opposite end portions of the transom 56 are secured to the aft or rear end faces of the rear floats 44 with similar fastener assemblies 46. As best shown in FIGS. 12 and 13, when the shield 45, the seats 52, 54 and transom 56 are detached they can be stored and carried in the suitcase enclosure alongside the floats 42 and 44 when the pan sections 24 and 26 are in the confronting position ready for transport.

In order to retain the pan sections 24 and 26 in a confronting position in suitcase form to carry the floats 42 and 44 along with the shield 45, fasteners, etc., seats 52 and 54 and transom 56 therein, a pair of flexible straps 60 with suitable buckles or connectors are encircled around the assembled confronting pan sections and cinched up tight. A carrying handle 62 is secured to the upper rim of the tightened strap 60 to facilitate easy carrying and handling of the suitcase boat 20 during transport and storage while not in use as a floating boat.

From the foregoing, it will be appreciated that the suitcase boat 20 is easily transportable when folded up to form a compact suitcase-like package as shown in FIGS. 10-13. When unfolded and extended so that the pan sections 24 and 26 are aligned in end to end position, the floats 42 and 44 are easily secured to the opposite sides 38 of the boat hull for flotation either as a flat bottom boat or a tunnel hull boat. The boat 20 is relatively low in cost and is constructed of easily obtainable materials. The boat 20 is useful as a floating swim platform, a motor boat, a sailboat, rowboat, etc. The boat is relatively light in weight, easy to assemble and disassemble, and is compact enough in size while in suitcase form to be transportable on common public conveyances such as airplanes, buses, trains, cars and the like.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A suitcase boat, comprising:

platform means for supporting a person(s) and/or object(s) while said boat is on the water, said platform means comprising a plurality of sections interconnectable and relatively movable between a confronting position forming a hollow rectangular enclosure of suitcase form suitable for carrying and an extended position suitable for boating on the water;

said sections being adapted to be interconnected along a transverse axis projecting laterally of a longitudinal axis of said boat when in said extended position and each section providing a pair of opposite side walls of said suitcase enclosure when said sections are in said confronting position, said opposite side walls of said suitcase enclosure forming a bottom of said boat when said sections are in said extended position;

each of said sections including a pair of opposite first walls joining said opposite said side wall thereof forming a portion of an edge wall of said enclosure when in said confronting position and opposite sides of said boat when said sections are in said extended position;

a plurality of flotation elements adapted to support said platform means on the water while said sections are interconnected in said extended position and dimensioned to be contained within said suitcase enclosure when said sections are in said confronting position;

each of said sections including at least one transverse wall joined to said side wall thereof and said pair of opposite first walls thereof forming another edge wall of said suitcase enclosure when said sections are in said confronting position and a front or rear wall of said boat when said sections are in said extended position;

attachment means for securing said flotation elements to said platform means when said sections are in said extended position for providing flotation support for said boat; and carrying means for retaining said sections in said confronting position for containing said flotation elements in said hollow suitcase enclosure.

2. The suitcase boat of claim 1, wherein:

2 said sections are hingedly interconnected along said transverse axis of said boat.

3. The suitcase boat of claim 1, wherein:

said attachment means includes fastening means on different levels on said sections for securing said flotation elements thereto at a selected one of several of said levels.

4. The suitcase boat of claim 3, including:

a first group of said fastening means on a first of said levels for securing said flotation elements on said sections in a first relative position wherein undersides of said flotation elements are substantially even with said opposite side walls of said sections in said extended position forming a flat bottom boat.

5. The suitcase boat of claim 4, including:

a second group of said fastening means on a second of said levels for securing said flotation elements in a second relative position wherein undersides of said flotation elements are spaced below said opposite side walls of said sections in said extended position forming a tunnel hull boar.

6. The suitcase boat of claim 5, wherein:

said sections are made of resinous plastic material and said flotation elements are made of cellular foam.

7. The suitcase boat of claim 1, including:

a detachable seat mounted above said interconnected sections in said extended position and containable with said suitcase enclosure when said sections are in said confronting position.

8. The suitcase boat of claim 7, including:

fastening means for securing opposite ends of said seat to said flotation elements on opposite sides of said section in said extended position.

9. The suitcase boat of claim 1, including:

a detachable seat mounted adjacent a front end of said boat when said sections are in said extended position, said seat dimensioned for containment in said suitcase enclosure along with said flotation elements when said sections are in said confronting position.

10. The suitcase boat of claim 1, including:

said flotation elements and one of said sections at a rear end of said boat dimensioned for containment in said suitcase enclosure when said sections are in said confronting position.

11. A suitcase boat, comprising:

platform means for supporting a person(s) and/or object(s) while said boat is floating on the water, said platform means comprising a plurality of pan sections interconnectable and relatively movable between a confronting position providing a hollow rectangular enclosure of suitcase form for easy carrying and an extended end to end position for floating on the water;

each of said pan sections including a bottom wall providing a bottom wall of said boat when in said end to end position and opposite side walls said enclosure when in said confronting position, each pan section including a first pair of opposite sides joining said bottom wall thereof providing opposite walls said suitcase enclosure in said confronting position and opposite sides of said boat when in said end to end position, each of said pan sections further including at least one transverse end wall joining said bottom wall and paid of said opposite side thereof forming a wall portion of said suitcase enclosure when in said confronting position and a front or rear wall of said boat when in said end to end position;

a plurality of flotation elements adapted to support said platform means on the water while said pan sections are in said end to end position and dimensioned to be contained within said hollow enclosure when said pan sections are in said confronting position;

attachment means for securing said flotation elements to said platform means when said pan sections are in said end to end position for providing flotation support for said boat on the water; and means for retaining said pan sections in said confronting position for containing said flotation elements therein for easy carrying.

12. The suitcase boat of claim 11, wherein:

pairs of said flotation elements are substantially identical in size and shape.

13. The suitcase boat of claim 12, wherein:

said flotation elements are made of lightweight closed cell foam material.

14. The suitcase boat of claim 13, wherein:

said foam material is enclosed within an outer jacket of thin sheet plastic material.

* * * * *